United States Patent [19]

Nakagawa et al.

[11] 4,320,629

[45] Mar. 23, 1982

[54] REFRIGERATING APPARATUS

[75] Inventors: Noboru Nakagawa, Osaka; Toshiyuki Oonishi, Takatsuki; Masato Tsutsumi, Osaka; Akira Kawamoto, Takatsuki, all of Japan

[73] Assignee: Tokyo Shibaura Denki Kabushiki Kaisha, Kawasaki, Japan

[21] Appl. No.: 153,134

[22] Filed: May 27, 1980

[30] Foreign Application Priority Data

Aug. 8, 1979 [JP] Japan ..... 54/101090

[51] Int. Cl.[3] ..... F25B 41/00; F25B 41/06

[52] U.S. Cl. ..... 62/198; 62/511; 62/526

[58] Field of Search ..... 62/198, 199, 525, 511, 62/509, 526

[56] References Cited

U.S. PATENT DOCUMENTS

| | | | |
|---|---|---|---|
| 2,697,331 | 12/1954 | Zearfoss, Jr. | 62/227 X |
| 2,750,757 | 6/1956 | Zearfoss, Jr. | 62/198 |
| 2,791,101 | 5/1957 | Zearfoss, Jr. | 62/229 X |
| 2,794,324 | 6/1957 | Zearfoss, Jr. | 62/509 X |
| 3,638,447 | 2/1972 | Abe | 62/511 |
| 4,130,997 | 12/1978 | Hara et al. | 62/504 |
| 4,242,880 | 1/1981 | Niida | 62/525 |

*Primary Examiner*—Albert J. Makay
*Assistant Examiner*—Harry B. Tanner
*Attorney, Agent, or Firm*—Cushman, Darby & Cushman

[57] ABSTRACT

A refrigerating apparatus with at least two evaporators which are controlled at different temperatures by a refrigerant, a vapor bubble pump for pumping the refrigerant and a first and second pressure regulators of the refrigerant which are located on the upstream side of the evaporators.

1 Claim, 7 Drawing Figures

REFRIGERATING APPARATUS

This invention relates to a refrigerating apparatus, more particularly to an improvement in a refrigerating apparatus in which at least two evaporators are controlled to a different temperature.

Generally, a refrigerator having a freezing compartment and refrigerating compartment which are controlled to a different temperature has separate evaporators for the freezing compartment and for the refrigerating compartment because separate cooling is necessary for each compartment. The temperatures of the compartments are controlled by a solenoid valve which is located in a conduit path connecting the freezing evaporator and the refrigerating evaporator for controlling refrigerant flow to one or both of the evaporators.

However, such solenoid valve has a mechanically movable valve which is buried in heat insulating material so that it is difficult to maintain or inspect the valve after the refrigerator is assembled. Accordingly, the life and the reliability of the refrigerator are not sufficient, and, moreover, this structure is too expensive.

Recently, a refrigerator which has a vapor bubble pump producing valve action to the refrigerant has been developed. However, this refrigerator has the drawback that the refrigerant flows into an auxiliary evaporator.

It is an object of this invention to provide a refrigerating apparatus which can avoid the leakage of refrigerant flow into an auxiliary evaporator.

It is another object of the invention to provide a refrigerating apparatus which has at least two pressure regulators for the refrigerant.

It is a further object of the invention to provide a refrigerating apparatus which has first pressure regulator located on the upstream side of a refrigerator evaporator and a second pressure regulator located upstream side of a freezing evaporator.

In this invention at least two evaporators are connected by conduit through which flows a refrigerant, with a vapor bubble pump for pumping the refrigerant formed in one of the conduits. Two pressure regulators are located in the path of the refrigerant, one of which is located on the upstream side of one of the evaporators and the other of which is located on the upstream side of the other evaporator. The regulators control flow of the refrigerant when the vapor bubble pump is in operation and not in operation.

FIG. 3 shows that the vapor bubble pump not in operation, and FIG. 4 shows that the vapor bubble pump in operation;

Figure 1:
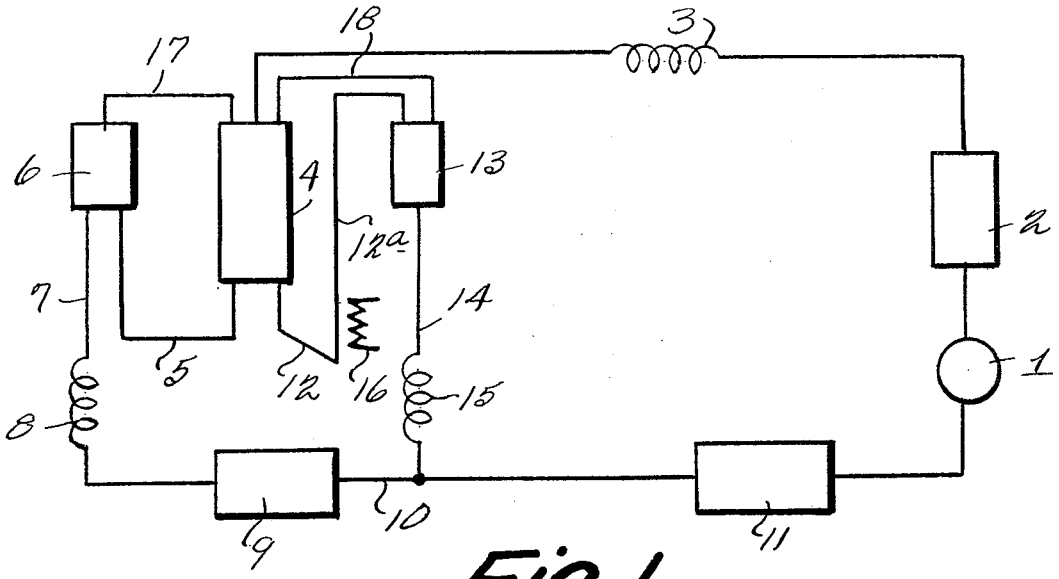
FIG. 1 is a schematic view of a refrigerating apparatus of this invention.

Referring to FIG. 1, high temperature gas of a refrigerant which is compressed by a compressor 1 is condensed by a condenser 2 and supplied to a liquid tank 4 through a pressure regulator such as capillary tube 3. One end of a U-shaped conduit 5 is located in tank 4 and extends through the bottom of tank 4. The other end of conduit 5 is connected to the bottom opening of an accumulator or reservoir 6. One end of a conduit 7 is located in accumulator 6 and extends through the bottom thereof. Conduit 7 is connected to a refrigerator evaporator 9. A first pressure regulator such as a capillary tube 8 is located in the upstream side of refrigerator evaporator 9. Refrigerator evaporator 9 is connected to a freezer evaporator 11 by a connecting conduit 10, and evaporator 11 is connected to compressor 1 to form a closed refrigerating cycle.

One end of another U-shaped conduit 12 is connected to an opening in the top of a joint box 13 by bending downwardly. A rising portion 12$^a$ of conduit 12 extends higher than the top of conduit 7 which is connected to accumulator 6. One end of a conduit 14 is connected to the bottom opening of joint box 13 and the other end of conduit 14 is connected to connecting conduit 10. A second pressure regulator 15 such as a capillary tube is located in the upstream side of freezer evaporator 11. A heater 16 is wound around the outer surface of lower part of rising portion 12$^a$. Rising portion 12$^a$ and heater 16 form a vapor bubble pump A. The inner pressure of tank 4, accumulator 6 and joint box 13 are equalized by conduit 17 and 18 which are connected between tank 4 and accumulator 6 and between tank 4 and joint box 13, respectively.

Figure 2:
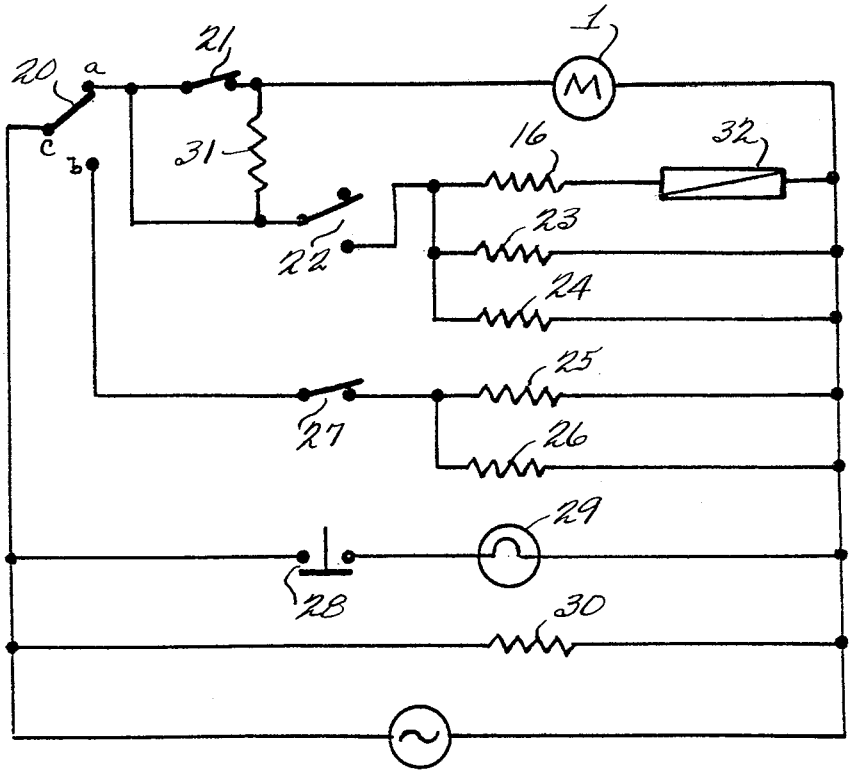
FIG. 2 is a wiring diagram of the invention.

FIG. 2 is a wiring diagram of this invention. The motor of compressor 1 is driven when the contact (c-a) of a defrost switch 20 is closed and a control switch 21 of the freezing compartment is closed. Heater 16 of vapor bubble pump A, a connect pipe heater 23 and drain gutter heater 24 are energized when the temperature of the refrigerating compartment falls below a predetermined value and a control switch 22 of the refrigerating compartment is turned on. The motor of compressor 1 is stopped when the freezing compartment is cooled to a predetermined temperature and control switch 21 of freezing compartment opens. The defrosting cycle, which is conventional, is attained by energizing a defrost heater 25 and a defrost sensor heater 26. A defrost bimetal switch 27 opens when the defrosting cycle is finished. A door switch 28 is closed when the door of refrigerating compartment is opened and a lamp 29 which is located in the refrigerating compartment is turned on. A drain pipe heater 30 is located near the drain pipe of the freezing compartment, a heater 31 heats freezer control switch 21 and a fuse 32 is located in series with heater 16 of vapor bubble pump A.

Figure 3:
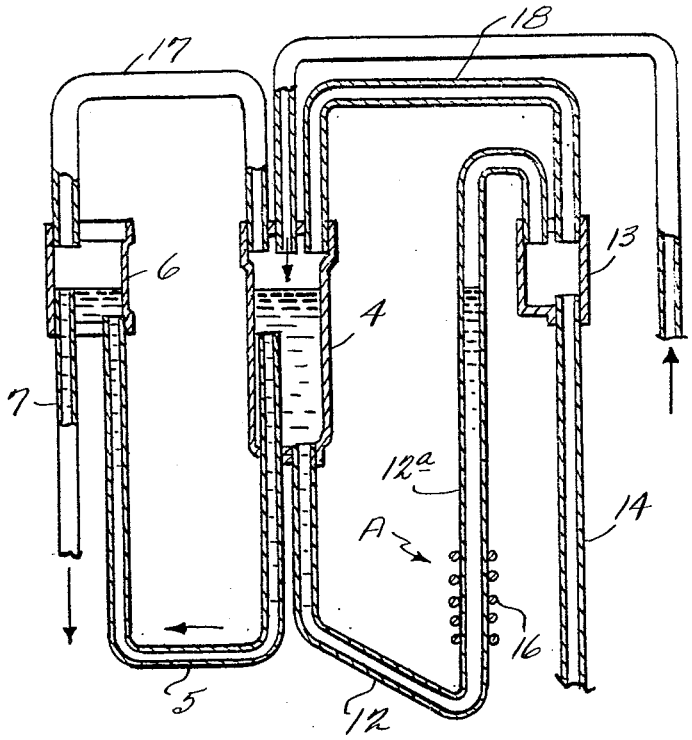
FIG. 3 and FIG. 4 show operation of a vapor bubble pump of the invention.

The operation of the invention will now be explained. When the temperature of the refrigerating compartment and the freezing compartment is higher than the predetermined value, control switch 21 of the freezing compartment is kept closed and control switch 22 of the refrigerating compartment is kept open. Then the motor of compressor 1 is driven while heater 16 is kept deenergized. The refrigerant which is compressed by compressor 1 and condensed by condenser 2 is stored in liquid tank 4. The liquid refrigerant flows into accumulator 6 through U-shaped conduit 5 when the liquid level in tank 4 rises higher than the top of U-shaped conduit 5 in tank 4. The liquid refrigerant goes to refrigerator evaporator 9 and freezer evaporator 11, through conduit 7 and capillary tube 8 so that the refrigerating compartment and the freezing compartment are both cooled. In this condition, the liquid refrigerant does not flow into conduit 14 through U-shaped conduit 12 and joint box 13 because the inner pressure of tank 4, accumulator 6 and joint box 13 are kept equal by conduits 18 and 19 as the liquid level in tank 4, accumulator 6 and U-shaped conduit 12 are kept equal, and because rising portion 12$^a$ extends higher than the top of conduit 7 (see FIG. 3).

Figure 4:
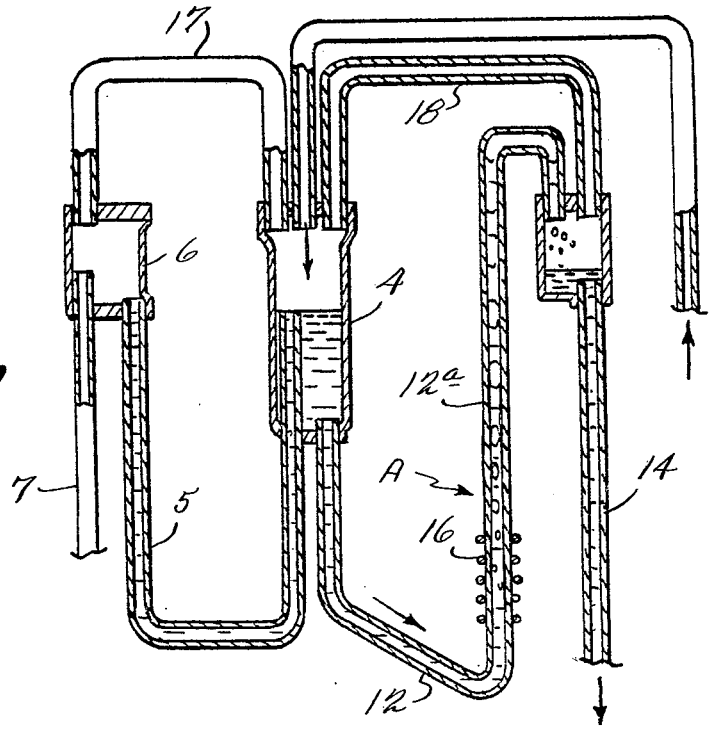

Heater 16 is energized when control switch 22 turns on so that the refrigerator compartment is cooled at the predetermined temperature. Vapor bubbles of liquid refrigerant in rising portion 12$^a$ are produced by heating rising portion 12$^a$ with heater 16. The liquid refrigerant is pumped up by the bubbles and overflows from the top of rising portion 12$^a$ into joint box 13 (see FIG. 4). Then, the liquid refrigerant flows into freezer evaporator 11 through conduit 14 and capillary tube 15, and cools the freezing compartment. At this time, the liquid level in tank 4 is reduced as the liquid refrigerant flows into freezer evaporator 11 through joint box 13. The cooling of refrigerating compartment is interrupted when the flow of the liquid refrigerant into refrigerator evaporator 10 is stopped. Since the temperature of the refrigerating compartment is lower than the predetermined temperature, compressor 1 is controlled in order to increase and decrease the temperature of the freezing compartment. When the temperature of the refrigerating compartment rise above the predetermined temperature, the action of vapor bubble pump A stops because control switch 22 is opened. The liquid refrigerant then flows and cools through both the refrigerating and the freezing compartments via accumulator 6.

Figure 5:
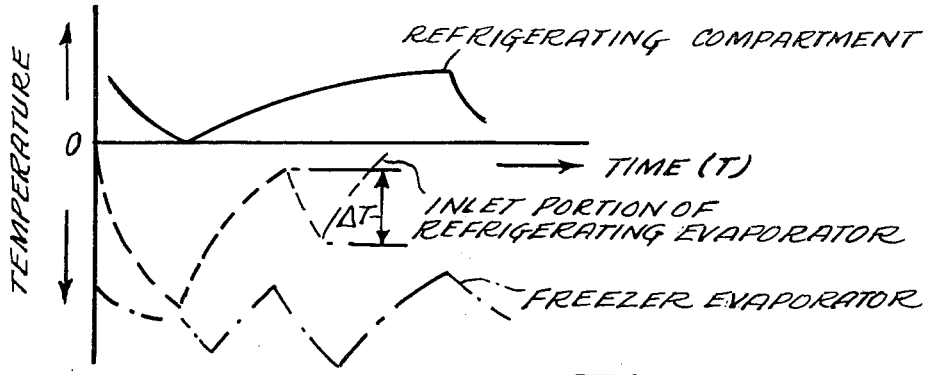
FIG. 5 is a diagram between time and the temperature of the inlet portion of a refrigerator evaporator.
Figure 6:
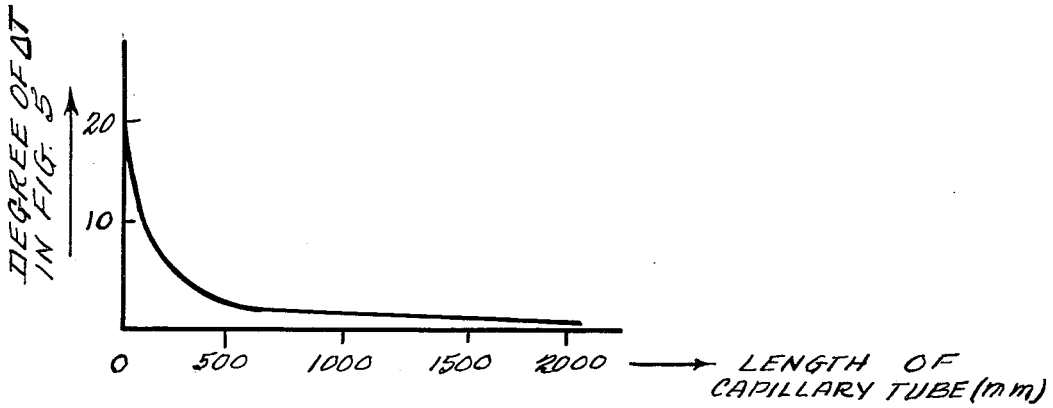
FIG. 6 is a diagram between the temperature fall t (shown in FIG. 5) of the inlet portion of a refrigerator evaporator and the length of a capillary tube which is located in the upstream side thereof.

Referring to FIG. 5, a solid line shows the temperature of the refrigerating compartment, a dotted line shows the temperature of the inlet portion of refrigerator evaporator 9 and a dotted broken line shows the temperature of freezer evaporator 11. If the liquid refrigerant flows into refrigerator evaporator 9 through accumulator 6 and conduit 7 when vapor bubble pump A is "in operation" namely, refrigerator evaporator 9 is not in operation, the inlet portion of refrigerator evaporator 9 is cooled because the liquid refrigerant is vaporized at the inlet portion of refrigerator evaporator 9. The temperature of the inlet portion of refrigerator evaporator 9 momentarily falls according to the beginning of the evaporation of freezer evaporator 11. Then, the inlet portion of refrigerator evaporator 9 is frozen and the contents of the refrigerating compartment such as vegetables are frozen in certain circumstances. In the foregoing embodiment, the leakage of the refrigerant to refrigerator evaporator 9 can be avoided because the pressure regulator such as capillary tube 8 which acts as a resistance to the refrigerant flow is located in the upstream side of refrigerator evaporator 9. FIG. 6 shows a diagram between the temperature decrease t (shown in FIG. 5) of the inlet portion, namely, the upstream side of refrigerator evaporator 9 and the length of capillary tube 8 which has a 1.2 mm inner diameter. The temperature fall t is small when the length of capillary tube 8 is larger than 300 mm.

Figure 7:
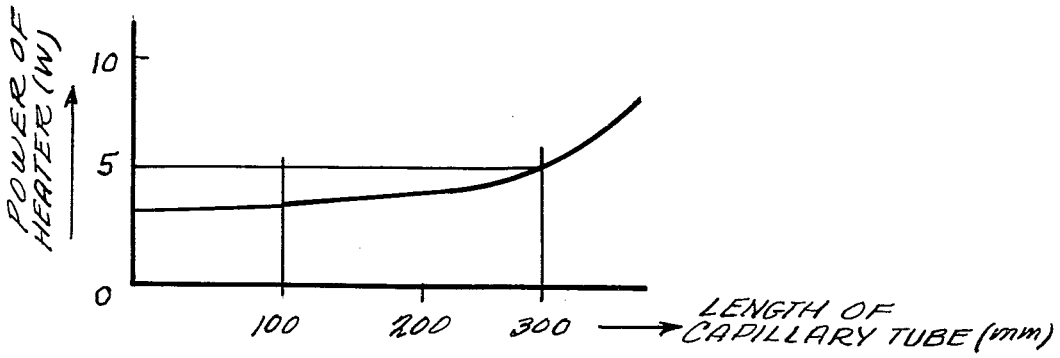
FIG. 7 is a diagram between the power of a vapor bubble pump and the length of a capillary tube which is located in the path of refrigerant pumped up by the vapor bubble pump.

In a refrigerator having a vapor bubble pump, the refrigerant flow is controlled by pressure balance of each conduit. When vapor bubble pump A is "not in operation", the pressure regulator such as capillary tube 15 which has a larger resistance to the refrigerant flow than capillary tube 8 and for acting as a resistance to the refrigerant flow is located in the upstream side of freezer evaporator 11 according to the location of capillary tube 8 in the upstream side of refrigerator evaporator 9. Thus, it is able to prevent the bypassing of the refrigerant flow to freezer evaporator 11 through U-shaped conduit 12. It is necessary to increase the power of heater 16 for producing the same vapor bubble pumping action because the temperature of rising portion 12$^a$, namely, the portion of vapor bubble pump A rises according to the location of capillary tube 15 in conduit 14. FIG. 7 shows a diagram between the power of vapor bubble pump A and the length of capillary tube 15 which has a 0.7 mm inner diameter. The length of capillary tube 15 is smaller than 300 mm when the power of vapor bubble pump is 5 watt. For keeping the resistance of capillary tube 15 is larger than the resistance of capillary tube 8, as a result of a experiment, the length of capillary tube 8 which has a 1.2 mm inner diameter must be smaller than 2000 mm when capillary tube 15 which is located upstream side of freezer evaporator 11 has a 0.7 mm inner diameter and a 300 mm length and the length of capillary tube 15 which has a 0.7 mm inner diameter must be larger than 100 mm when capillary tube 8 which is located upstream side of refrigerator evaporator 9 has a 1.2 mm inner diameter and a 300 mm length.

In the above described embodiment, the refrigerant flows only to freezer evaporator 11 when vapor bubble pump A is in operation, but it may be possible to flow the refrigerant to both freezer evaporator 11 and refrigerator evaporator 9 when vapor bubble pump A is in operation.

What is claimed is:

1. Refrigerating apparatus comprising:

a compressor for compressing a refrigerant, a tank for storing said refrigerant, at least two evaporators serially connected and controlled to a different temperature by evaporation of said refrigerant, one of said evaporators being a freezer evaporator and the other a refrigerator evaporator, first and second liquid reservoirs respectively connected between said tank and each evaporator, a plurality of conduits for flowing said refrigerant to said compressor, said evaporators, said reservoirs and said tank, a vapor bubble pump for pumping said refrigerant from said tank and for controlling the flow of said refrigerant to the junction of said evaporators and then through said freezer evaporator, and first and a second pressure regulators for regulating the pressure of said refrigerant, said first pressure regulator being located on the upstream side of said refrigerator evaporator between said first reservoir and said refrigerator evaporator in which said refrigerant flows when said vapor bubble pump is not in operation and said second pressure regulator being located between said second reservoir and said junction and in which said refrigerant flows when said vapor bubble pump in operation, said regulators each being capillary tubes with said second regulator having a greater resistance to refrigerant flow than said first regulator.

* * * * *